United States Patent [19]

Marton

[11] Patent Number: 4,812,954

[45] Date of Patent: Mar. 14, 1989

[54] APPARATUS FOR BACK LIGHTING MARBLE FOR DECORATIVE FURNITURE ITEMS

[76] Inventor: Joseph S. Marton, 608-1/2 N. Sycamore, Los Angeles, Calif. 90036

[21] Appl. No.: 194,097

[22] Filed: May 16, 1988

[51] Int. Cl.[4] ..... H47B 97/00

[52] U.S. Cl. ..... 362/134; 362/145; 362/224; 362/351; 362/806

[58] Field of Search ..... 362/351, 127, 134, 145, 362/223, 224, 260, 311, 362, 806; 52/28, 306

[56] References Cited

U.S. PATENT DOCUMENTS 785,695 3/1905 Munns ..... 362/145

1,043,557 11/1912 Young ..... 362/127

FOREIGN PATENT DOCUMENTS 258062 9/1926 United Kingdom ..... 362/145

*Primary Examiner*—Stephen F. Husar

*Attorney, Agent, or Firm*—Thomas I. Rozsa

[57] ABSTRACT

An apparatus for enhancing the beauty of marble by back lighting the marble to thereby cause the majority of the marble to be illuminated while the veins in the marble block the light and thereby stand out from the marble. A tower structure is comprised of marble walls which preferably are no thicker than ¼ to ½ inch and are light colored such as white or light grey. The tower is hollow and further comprises a lighting fixture within it to provide of source of light to back light the rear interior marble walls, and thereby cause the light to shine through the marble surrounding the veins and enhance the beauty of the veins within the marble. The preferred source of lighting is fluorescent.

10 Claims, 1 Drawing Sheet

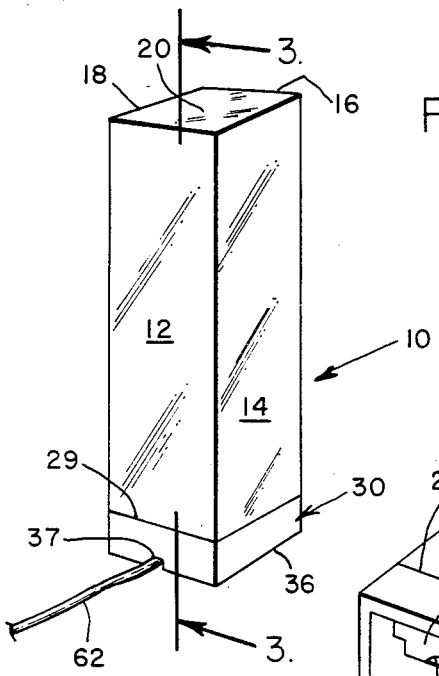
Fig. 1.
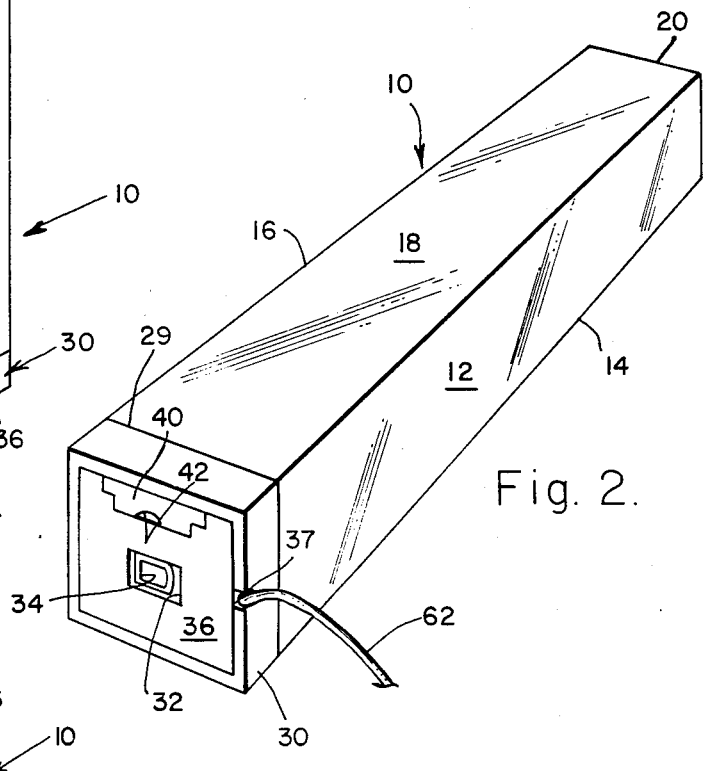
Fig. 2.
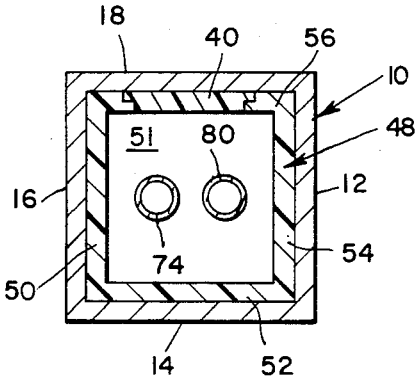
Fig. 4.
Fig. 3.
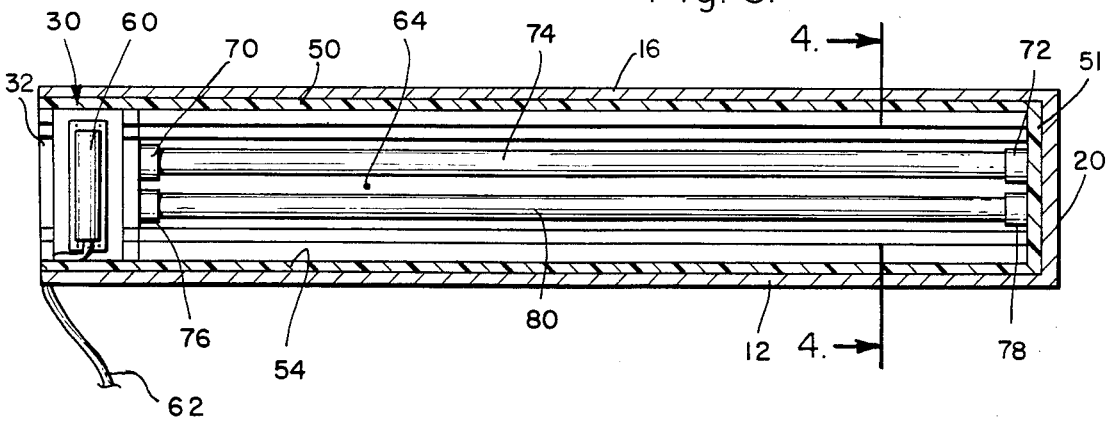

APPARATUS FOR BACK LIGHTING MARBLE FOR DECORATIVE FURNITURE ITEMS

BACKGROUND OF THE INVENTION

1. FIELD OF THE INVENTION

The present invention relates to the field of enhancing the beauty of furniture items through decorative back lighting. In particular, marble is a beautiful stone and is frequently used in furniture items such as the top of a counter or table. The field of the present invention concerns enhancing the beauty of marble furniture through back lighting to bring forth the beauty of the veins of the marble.

2. DESCRIPTION OF THE PRIOR ART

In general, back lighting has been used with mirrors and similar objects where a special optical effect is desired. In store windows, certain objects have been back lighted to enhance portions of the object.

It is well known to use marble for decorative construction and furniture items. Marble and granite are frequently used for counter tops in banks and for interior and exterior siding of buildings, as well as for floors in office buildings and in the home. Marble is also used for the counter top of dressers, vanity tables, and other items of furniture in the home and office.

In the past, no-one has ever thought of back lighting marble to enhance its beauty. This may be due to the fact that most people consider marble and granite to be too thick and too dark to effectively transmit light. It may also be due to the fact the marble and granite are frequently enclosed (such as on walls, on the floor, on counter tops or table tops) and therefore the thought of using a lighting source to enhance the marble's beauty simply has not occurred to designers.

It is believed that there is a significant need for enhancing the beauty of marble when used in furniture and similar items to thereby increase the sales of marble for this use and further enhance the beauty of the marble used for this purpose.

SUMMARY OF THE PRESENT INVENTION

The present invention relates to a novel method and apparatus for back lighting marble when used as furniture and in particular in a tower type structure which can serve as a base for lamps, vases and similar objects.

It has been discovered, according to the present invention, that while thin light marble is generally transparent and permits light to shine through it, certain areas of the marble such as the veins tend to be more opaque and will prevent light from being transmitted through them. Therefore, if the slab of marble is lit from the rear, the light will illuminate the veins and make them stand out from the rest of the marble since the light will shine through the rest of the marble and not the veins, thereby enhancing the marble's beauty.

It has also been discovered, according to the present invention, that if relatively thin marble which is no thicker than one-quarter ($\frac{1}{4}$) inch to one-half ($\frac{1}{2}$) inch and is made of light colors such as white or light grey is lighted from the rear, the thin and light colored marble will permit the light to be partially transmitted through the marble and enhance the definition of the veins in the marble to thereby create a stunningly beautiful enhancement of the marble.

It has further been discovered, according to the present invention, that if the thin sheets of marble are formed into a tower structure with a source of fluorescent lighting within the tower, the lighting will serve to enhance the veins and coloration of the marble. Further the porous nature of the marble will permit some of the light to be transmitted through the marble and enhance the beauty of the veins while portions of the marble will reflect the light back and permit it to be transmitted to another side of the marble tower (either an opposite wall or an adjacent wall) where it also is transmitted through the more transparent portions of the marble to provide an enhanced effect along with the direct source of light.

It has additionally been discovered, according to the present invention, that if a tower is formed of marble walls and a transparent housing within the tower further comprises a source of fluorescent light, the light will shine through the transparent housing and impinge on the exterior marble wall, where the veins will be illuminated and enhance the beauty of the marble.

It is therefore an object of the present invention to provide a method and apparatus for enhancing the beauty of marble by back lighting the marble to thereby cause the veins to be illuminated from and stand out from the marble.

It is another object of the present invention to provide a method and apparatus for beautifying marble furniture.

It is a further object of the present invention to provide a method and apparatus for enhancing the beauty of a marble tower used as a base for a lamp, vase or similar article by back lighting the marble walls of the tower through an interior source of light.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation, there is illustrated:

FIG. 1 is a perspective view of the present invention marble tower which comprises an interior lighting system for back lighting the marble walls, with the tower in an erect position.

FIG. 2 is a perspective view of the present invention marble tower which comprises an interior lighting system for back lighting the marble walls, with the tower lying on one side.

FIG. 3 is a lengthwise cross-sectional view taken along line 3—3 of FIG. 1.

FIG. 4 is a widthwise cross-sectional view taken along line 4—4 of FIG. 3.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

The concept of the present invention involving back lighting marble slabs to enhance their beauty will be illustrated in detail through a tower comprising marble walls with an interior illumination system. Referring to FIG. 1, there is illustrated at 10 the present invention interiorly illuminated tower. The tower 10 illustrated in FIG. 1 is generally rectangular in shape and comprises four vertical generally perpendicular walls, 12, 14, 16 and 18; a top 20 and a bottom 36 (illustrated in greater detail in FIG. 2). In the preferred embodiment, the four vertical generally perpendicular walls 12, 14, 16 and 18 are made of marble which is of light color such as white or light gray and has a generally uniform thickness in the range of approximately one-quarter (¼) inch to approximately one-half (½) inch. The top 20 is also preferably made of the same type of marble. The four walls and top comprise a generally rectangular tower with a hollow interior. Preferably, the four walls are of equal width, thereby comprising a generally square cross-section.

Within the hollow interior of the tower is a housing for the interior illumination system. In the preferred embodiment, the interior housing 48 generally conforms to the shape of the exterior walls of the tower and is sufficiently smaller to just fit within the interior hollow space of the tower by a press fit, as illustrated in FIG. 4. The interior housing 48 is comprised of four generally perpendicular walls, 50, 52, 54 and 56. Interior housing wall 50 lies adjacent exterior wall 16, interior housing wall 52 lies adjacent exterior wall 14, interior housing wall 54 lies adjacent exterior wall 12 and interior housing wall 56 lies adjacent exterior wall 18. As shown in FIG. 3, the interior housing 48 extends for most of the length of the tower and may also contain a top wall 51 adjacent exterior top 20. One of the interior housing walls, 56, comprises an opening means for gaining access to the interior of the interior housing. The opening means 40 is a press-fit removable section of wall which is press-fit through a step recess into interior housing wall 40 and can be lifted up from the housing by inserting a finger or other object into release means 42 and pushing upward on the opening means 40 until it pops out of its mating step groove. Preferably, the opening means 40 extends for most of the length of the wall 56 and is sufficiently wide to permit a person's hands and a fluorescent light bulb to be inserted within the housing. The walls 50, 52, 54 and 56 of interior housing 48 are preferably made of transparent material such as clear plastic, to permit the passage of light therethrough.

Contained within the interior housing 48 is an illumination source which may be a pair of fluorescent light bulbs 74 and 80 which run for most of the length of the tower. Fluorescent light bulb 74 is supported by fixture sockets 70 and 72 and fluorescent light bulb 80 is supported by fixture sockets 76 and 78. The bottom section 30 of interior housing 48 delineated as the area below line 29 (see FIG. 1) comprises the ballast and related electronics 60 for the fluorescent lighting system. The electronics 60 may be battery operated or electrical. In the embodiment illustrated, the electronics are electrical and a cord 62 extends out of an opening or notch 37 at the bottom portion of one of the walls (interior wall 54 and exterior wall 12 in FIG. 3). The bottom 36 of the tower and of section 30 further comprises a recess 32 into which folds a handle 34.

In operation, the interior illumination housing 48 is opened through opening means 40 by insertion of an object or finger in release means 42 and causing the opening means 40 to be removed from its groove. The fluorescent light bulbs 74 and 80 are then inserted into their respective fixtures. The opening means is then reinserted within the interior housing wall 56. With the tower on its side, the interior housing 48 is pushed into the tower so that its walls are flush with the inside of the exterior walls 12, 14, 16 and 18 of the tower. The handle 34 is folded into its recess and the tower is then vertically aligned, as illustrated in FIG. 1. If one or more of the light bulbs burns out it can be replaced by reversing the process just described. The tower is laid on its side and the interior housing 48 is pulled out by handle 34, the opening means opened as described, the burned out fluorescent light bulb removed and a new one inserted.

With the electronics 60 activated by plugging them in to an electronic outlet via cord 62, the fluorescent light bulbs are illuminated and serve to illuminate the interior of the tower. Since the walls 50, 52, 54 and 56 and top 51 of the interior housing are made of transparent material, the light from the fluorescent bulbs shines through them and onto the backside of the marble walls 12, 14, 16 and 18 and top 20. While marble is generally transparent and transmits light, certain areas of the marble such as the veins tend to be more opaque and will block light from travel through them. Therefore, when the walls of marble are lit from the rear, the light will illuminate the marble and not the veins and therefore cause the veins to stand out from the rest of the marble, thereby enhancing the marble's beauty. With the relatively thin marble walls which are preferably no thicker than one-quarter (¼) inch to one-half (½) inch and made of light colors such as white or light grey, the thin and light colored marble will permit the light to be partially transmitted through the marble and enhance the definition of the veins in the marble to thereby create a stunningly beautiful enhancement of the marble. With the thin sheets of marble formed into a tower structure with a source of fluorescent lighting within the tower, the lighting will serve to enhance the veins and coloration of the marble. Further the porous nature of the marble will permit some of the light to be transmitted through the marble and enhance the beauty of the veins while the more opaque portions of the marble will reflect the light back and permit it to be transmitted to another side of the marble tower (either an adjacent wall or a opposite wall) where it also is transmitted through the more transparent portions of the marble to provide an enhanced effect along with the direct source of light.

The preferred embodiment of the present invention is the tower structure since the marble walls can be enhanced by the source of direct light and well as reflected light bouncing off either opposite or adjacent walls. However, other structures having the exposed surface made of thin and light colored marble and being back lit to enhance the beauty of the veins in the marble are also within the spirit and scope of the present invention. For example, defined more broadly, the present invention is a structure comprising: (a) an outer wall at least partially enclosing an interior space within it and forming at least a partially enclosed structure; (b) the outer wall being at least partially made of thin light colored marble; and (c) a source of illumination located so as to project the illumination onto the rear of the outer wall at the location of the marble; (d) whereby the illumination onto the rear of the outer wall causes the veins in the marble to become enhanced. The source of illumination may be at least one fluorescent source of light and electronic means for activating and maintaining the illumination from the light. Preferably, the source of illumination is located within the structure and is further located within an interior transparent housing member located within the structure.

Defined even more broadly, the present invention is a structure comprising (a) an outer surface having a front wall and a rear wall, and at least partially made of thin light colored marble; and (b) a source of illumination set behind the said rear wall of the outer surface; (c) whereby said source of illumination shines onto said rear wall at the location of the marble and causes the marble to transmit some light while the veins block the light and thereby enhance the features of the veins relative to the rest of the marble.

While white and light gray are the preferred marble colors for the present invention, other colors which permit the light to shine through its veins are also within the spirit and scope of the present invention.

While the preferred lighting source is fluorescent, incandescent and/or neon light sources as well as other suitable light sources can also be substituted for the fluorescent light sources in the interior of interior illumination housing 48. While two fluorescent light sources are the preferred illumination means, the present invention will work properly with at least one fluorescent light source and may have any multiplicity of fluorescent light sources within the tower or other structure.

By way of example, the interior dimensions of the tower may be one foot square and four feet long. Any other dimensions are acceptable. In addition, shapes other than rectangular, such as cylindrical, elongated oval cross-section, etc. are also within the spirit and scope of the present invention.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A tower comprising:

a. four generally perpendicular generally rectangular shaped outer surface walls and a top adjoining the four walls to thereby form a hollow tower;

b. each of said four outer surface walls being made of thin light colored marble;

c. an interior housing member located within said tower and made of four generally perpendicular generally rectangular shaped transparent walls which removably press fit within the tower structure such that a respective one wall of the interior housing member lies adjacent the rear surface of a respective outer surface wall of the tower;

d. said interior housing member further comprising a source of illumination including at least one fluorescent source of light and electronic means for activating and maintaining the illumination from the light; and e. said interior housing member further comprising an opening means located in one of its walls to permit access to the interior of the interior housing member;

f. whereby when said source of illumination is activated, the fluorescent light causes light to shine through the transparent walls of the interior housing member and onto the rear surface of each of the outer surface wall to illuminate the marble and cause the veins in the marble to become enhanced and stand out from the remainder of the marble.

2. The invention in accordance with claim 1 wherein the thickness of said marble is from approximately one-quarter inch to approximately one-half inch.

3. The invention in accordance with claim 1 wherein said marble is white marble.

4. The invention in accordance with claim 1 wherein said interior housing member further comprises means for removing the interior housing member from the four outer surface walls of the tower.

5. The invention in accordance with claim 4 wherein said interior housing member further comprises a base and the means for removing the interior housing member is a recessed handle located on the bottom of the base.

6. The invention in accordance with claim 1 wherein said opening means is a removable section in one of the walls of the interior housing member which is press fit into a stepped groove in the wall and can be removed by lifting the removable section out of its stepped groove.

7. A structure comprising:

a. an outer wall at least partially enclosing an interior space within it and forming at least a partially enclosed structure;

b. the outer wall being at least partially made of thin light colored marble;

c. a source of illumination located so as to project the illumination onto the rear of the outer wall of the location of the marble;

d. said source of illumination located within the structure; and e. said structure further comprising an interior transparent housing member located within the structure and housing said source of illumination;

f. whereby the illumination onto the rear of the outer wall causes the veins in the marble to become enhanced.

8. The structure in accordance with claim 7 wherein said source of illumination is at least one fluorescent source of light and electronic means for activating and maintaining the illumination from the light.

9. The invention in accordance with claim 7 wherein the thickness of said marble is from approximately one-quarter inch to one-half inch.

10. The invention in accordance with claim 7 wherein said marble is white marble.

* * * * *